United States Patent [19]

Ohi

[11] Patent Number: 4,805,345

[45] Date of Patent: Feb. 21, 1989

[54] SEALING DEVICE FOR A DOOR

[75] Inventor: Kenji Ohi, Osaka, Japan

[73] Assignee: Nankai Kogyo Kabushiki Kaisha, Osaka, Japan

[21] Appl. No.: 71,818

[22] Filed: Jul. 10, 1987

[51] Int. Cl.[4] ..... E06B 7/20

[52] U.S. Cl. ..... 49/308; 49/310

[58] Field of Search ..... 49/308, 307, 306, 309, 49/310, 311, 303

[56] References Cited

U.S. PATENT DOCUMENTS

| | | | |
|---|---|---|---|
| 649,150 | 5/1900 | Winter | 49/308 |
| 2,171,070 | 8/1939 | Raible | 49/308 |
| 2,848,767 | 8/1958 | Thompson | 49/308 |
| 3,418,753 | 12/1968 | Hanson | 49/308 |
| 4,283,884 | 8/1981 | Dumenil et al. | 49/307 |
| 4,320,598 | 3/1982 | Rodak et al. | 49/481 |
| 4,406,088 | 9/1983 | Berndt, Jr. | 49/309 |
| 4,425,738 | 1/1984 | Christensen | 49/310 |
| 4,479,330 | 10/1984 | Muller | 49/303 |
| 4,519,165 | 5/1985 | Cronenberg et al. | 49/307 |

FOREIGN PATENT DOCUMENTS

| | | | |
|---|---|---|---|
| 608870 | 9/1948 | United Kingdom | 49/307 |

*Primary Examiner*—Philip C. Kannan

*Attorney, Agent, or Firm*—Browdy & Neimark

[57] ABSTRACT

Sealing device for a door, which comprises a sealing element provided on the lower edge of the door and being in the upper position when the door is opened and moving down when the door is shut to eliminate the clearance between the door edge and the floor. The sealing element is supported by an oscillating lever, which rotates to make the sealing element move up and down.

3 Claims, 2 Drawing Sheets

SEALING DEVICE FOR A DOOR

FIELD OF THE INVENTION

This invention relates to a sealing device for use in improving indoor airtightness by eliminating the clearance between the lower edge of a door and the floor when the door is closed.

BACKGROUND OF THE INVENTION

Conventionally many sealing devices have already been disclosed. A sealing device is generally constructed such that a sealing element is installed to the lower edge of the door, and the sealing element moves up when the door is opened and moves down when the door is closed, thereby eliminating the clearance between the door's lower edge and the floor.

This sealing element is inserted in an assembly secured to the door's lower edge so as to appear and disappear freely, and the sealing element is moved upwardly by the spring force when the door is opened.

Various operating means have been employed to move this sealing element down.

For example, U.S. Pat. Nos. 4,437,735 and 4,283,884 disclose a system constructed such that a spring rod is provided at the upward position of sealing element, one end of the spring rod being made to protrude from a side edge of the door.

When the door is closed, the rod end collides with the frame installed for the door and is thereby pushed in, and the spring rod sags to push an upper surface of then sealing element and make the sealing element move down.

SUMMARY OF THE INVENTION

An object of the invention is to provide a sealing device to eliminate the clearance between the door's lower edge and the floor by means of a sealing element which is installed onto the door's lower edge to disappear and appear freely and which moves down when the door is closed. A further object of the invention is to provide a sealing device capable of eliminating the clearance between the door's lower edge and the floor by using the rotation of a lever to actuate the sealing element even where the maximum distance for the sealing element to move up and down is elongated or the clearance between the door's lower edge and the floor is large.

A still further object of the invention is to provide a sealing device so arranged as to move up and down without any displacement in the lengthwise direction when the sealing element moves up and down.

Another object of the invention is to provide a sealing device capable of moving without lateral deviation when the sealing element moves up and down.

Yet another object of the invention is to provide a sealing device having the sealing element capable of moving up and down smoothly and acting accurately.

Other advantages and features of the invention may be apparent from the following description with the accompanying drawing.

DESCRIPTION OF PREFERRED EMBODIMENTS

Figure 1:
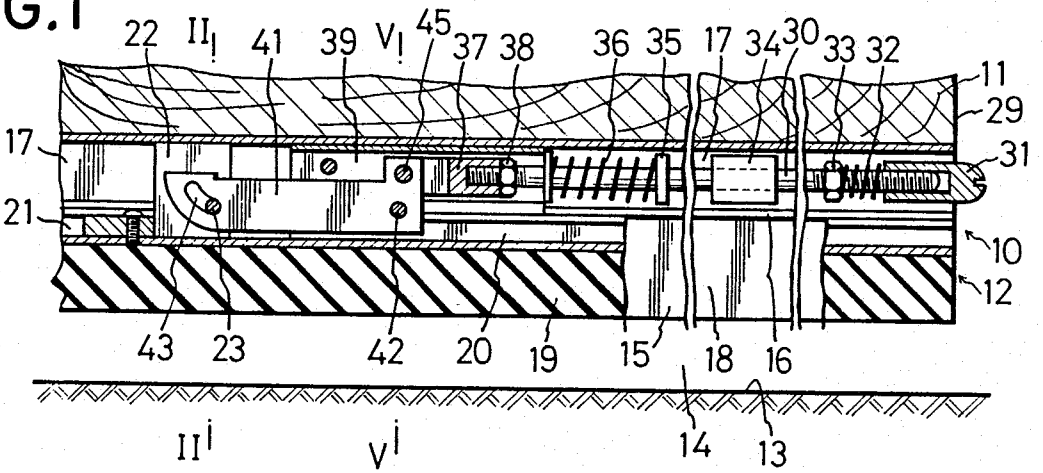
FIG. 1 is a sectional view showing the condition of a sealing element moving up according to the present invention.
Figure 3:
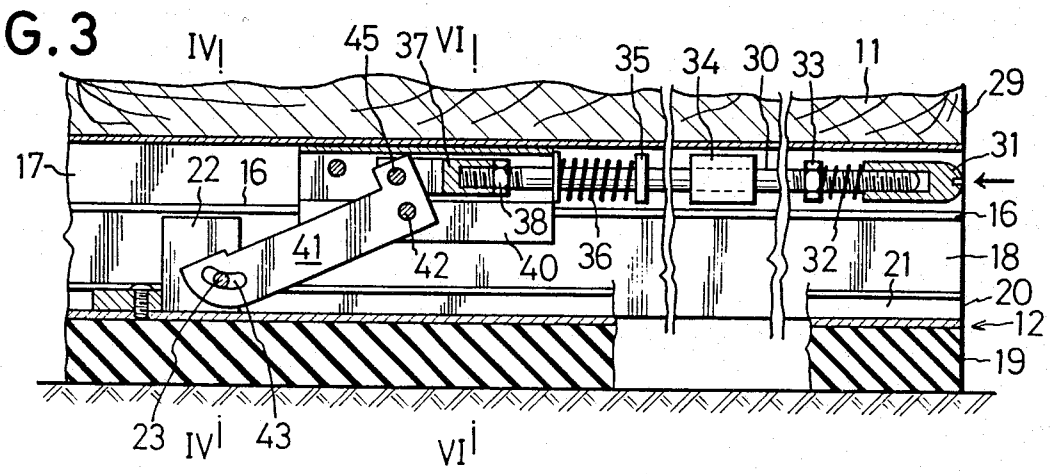
FIG. 3 is a sectional view showing the condition of the sealing element moving down.

FIG. 1 shows the sealing device (10) mounted in the lower edge of a door. In the preferred embodiment of this drawing, the sealing device (10) is mounted in a state of continuing to the lower edge of a door (11) while it is also possible, as another preferred embodiment, to install a sealing element (12) in a groove formed on the door's (11) lower edge and embed the sealing device (10) therein.

FIG. 1 shows the condition of the sealing element (12) moved upwardly. There is a clearance between the lower end of the sealing element (12) and the floor (13).

This condition will not allow the sealing element (12) and the floor (13) to rub each other even when the door (11) is opened or closed. There are two kinds of doors (11) available according to the present invention comprising one having a system arranged such that one side edge of the door is hinged to make the door swing open or closed, and another having a system arranged such that the door is suspended from the rail above and the door may be moved in the linear direction to be opened or closed.

Construction of the sealing device (10) will now be described. A U-shaped channel member (15) is secured to the lower edge of door (11) such that the opening portion thereof faces downwardly.

The inner portion of the channel member (15) is divided into an upper chamber (17) and a lower chamber (18) by means of protruded partitions (16) which protrude from both sides of the inner portion.

The lower chamber (18) incorporates the sealing element (12) appearing and disappearing freely in the upward and downward directions.

A lower portion (19) of the sealing element (12) is composed of resilient material such as rubber and soft synthetic resin so as to be put in intimate contact with the floor (13).

An upper portion of the sealing element (12) is composed of a metallic element having a slot (21) on the upper surface thereof.

A stabilizer (22) is secured to this slot (21).

The stabilizer (22) has two walls protruding upwardly and facing each other, and a pin (23) is mounted onto the two walls facing each other in the form of a bridge between them.

A rod (30) is provided in the upper chamber (17) to move freely in the axial direction.

A top end of the rod (30) and a contact element (31) are screw mounted. This contact element (31) is positioned such that the tip end thereof protrudes slightly from a side edge of the door (11) when the door is opened, and the tip end thereof collides with the door frame (not illustrated) and is thereby pushed in when the door is closed.

Position of the contact element (31) is freely adjustable by changing the amount of screwing of the contact element against the rod (30).

A nut (33) is mounted on the rod (30), a spring (32) is mounted between the nut (33) and the contact element (31), and the spring (32) always gives pressure to the contact element (31), all of which are combined to prohibit the connection by means of screw between the contact element (31) and the rod (30) to be moved or removed.

A support member (34) is fitted into the upper chamber (17), and the rod (30) is inserted through the center of this support member (34).

A spring washer (35) is secured to the rod (30), and one end of a spring (36) coming into contact with this spring washer (35) always exerts pressure on the spring washer (35).

Therefore, force is always exerted onto the rod (30) in the direction that the contact element (31) tends to protrude from the side edge (29) of the door.

A slider (37) is connected to the other end of rod (30).

This connecting construction is made such that thread part on the end of rod (30) is screw connected to a tapped hole on the slider (37) and such connection is further enhanced by a nut (38).

The slider (37) is axially movable in an inner portion of a fixed spring (39).

Figure 6:
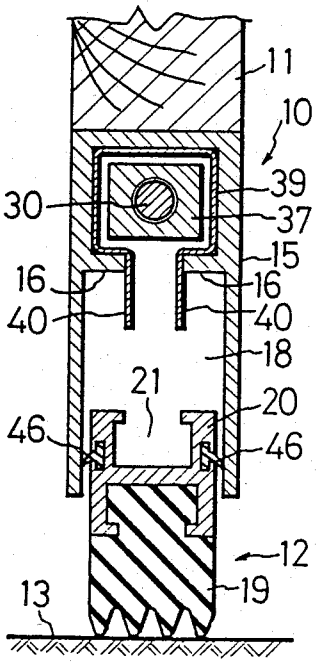
FIG. 6 a sectional view on the line VI—VI of FIG. 3.
Figure 5:
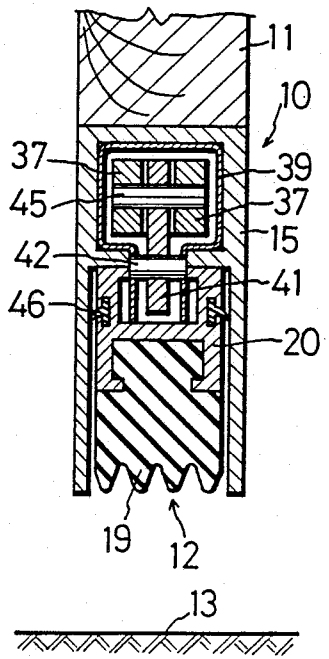
FIG. 5 a sectional view on the line V—V of FIG. 1.
Figure 4:
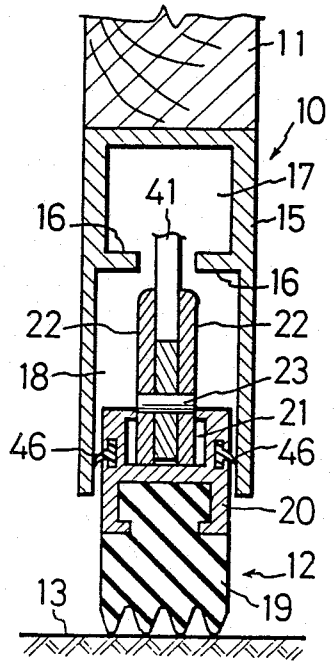
FIG. 4 is a sectional view on the line IV—IV of FIG. 3.
Figure 2:
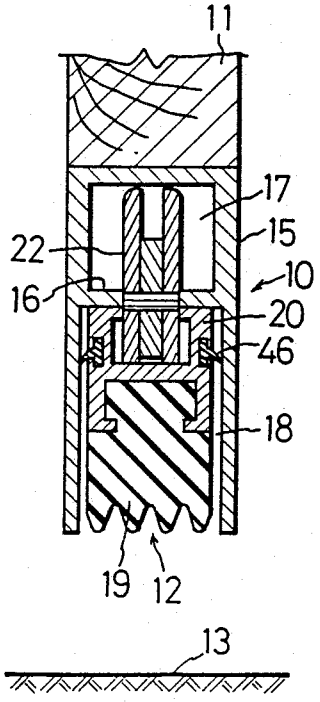
FIG. 2 is a sectional view on the line II—II of FIG. 1.

As illustrated in FIG. 5 and 6, the cylinder (39) is fixed inside the upper chamber (17) in a form positioned along the inner walls thereof.

A lower surface of the cylinder (39) is in a state of opening, and the lower surface walls of the cylinder (39) extends downwardly through the clearance formed by the protruded partitions (16), forming walls facing each other (40).

A lever (41) is slidably attached to the walls facing each other (40) by means of a pin (42).

An arc-shaped slot (43) is formed on the end of the lever (41), and the pin (23) secured to the stabilizer (22) is fitted into the slot (43).

The lever (41) is also connected to the slider (37) by means of a pin (45). Therefore, when the slider (37) axially moves, the lever (41) rotates using the pin (42) as the fulcrum, and the pin (23) fitted into the slot (43) located on the end of lever (41) is movable up and down.

The pin (23) is secured to the stabilizer (22), which is secured to the sealing, element (12), and therefore, the sealing element (12) moves up and down in parallel to the movement of the pin (23).

Preferably, the position where the stabilizer (22) is to be installed is almost the central portion of sealing element (12).

If the position where the stabilizer (22) is to be installed is extremely inclined to either of the sides, it will prevent the sealing element (12) from smoothly moving up and down.

Both side walls of sealing element (12) are provided with auxiliary sealing element (46).

The auxiliary sealing elements (46) are composed of resilient material and imbedded into the sealing element (12) such that the tips thereof protrude. The protruded noses of the auxiliary sealing elements (46) are in contact with the inner walls of channel member (15).

Therefore, this enables the sealing element (12) and the channel member (15) to contact airtight. Action of the aforementioned sealing device will be now described.

The spring (36) force is always exerted onto the rod (30) and thereby pressure is exerted on the contact element (31) in a direction so that it tends to protrude.

Therefore so far as the contact element (31) does not collide with other objects that is to say while the door is opened, the contact element (31) moves in the direction that it protrudes.

The slider (37) also moves in parallel with the movement of the rod (30), and lever (41) rotates using the pin (42) as the fulcrum, the top end of lever (41) moves upwardly, the pin (23) fitted into the slot (43) is pulled up, and the sealing element (12) is made to move up.

The clearance between the lower edge of sealing element (22) and the floor (13) still exists at this moment.

Also, this situation is maintained by the force of spring (36). When the door is closed, the contact element (31) collides with the door frame (not illustrated), and the contact element (31) and the rod (30) are both pushed inwardly in opposition to the force of the spring (36).

In parallel with this, the slider (37) moves, and the lever (41) rotates using the pin (42) as the fulcrum to make the tip end of the lever (41) move down.

Then the pin (23) is pushed down and the sealing element (12) moves down to come into contact with the floor (13).

No clearance exists between the lower edge of the door and the floor.

This situation will continue while the door is closed and the contact element is pushed in by the door frame.

When the door is opened, the contact element (31) leaves the door frame to remove the force exerting pressure on the contact element (31), then the rod (30) moves due to the force of spring (36) and the sealing element (12) moves up, resuming the condition as shown in FIG. 1.

As the stabilizer (22) fitted in between the protruded partitions (16) acts as a guide for the sealing element (12) to move up and down, the sealing element (12) will not deviate during the movement.

The above description is intended as the embodiment of this invention and not as limiting the scope of the invention in this embodiment, and modifications may be made within the scope of the claims.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology employed herein is for the purpose of description and not of limitation.

What is claimed is:

1. A sealing device for a door comprising:

a channel member secured to the lower edge of the door, said channel member having an open face facing downwardly a sealing element provided inside the channel member, said sealing element being capable of movement in a upward or downward direction and having an lower portion made of an elastic material and a upper portion made of a rigid material;

a rod provided inside the channel member and movable in the axial direction;

said rod having a first tip end;

a first spring exerting pressure on the rod so that the tip end of the rod protrudes slightly from the side edge of a door;

a lever provided to oscillate against the channel member;

said lever having a first end and a second end;

the first end of said lever connected to the sealing element;

the second end of said lever connected to the rod;

a cylinder secured to an upper chamber almost at the center of the channel member;

a slider movably contained in the cylinder and connected to a second end of the rod;

a first pin providing said lever with oscillating motion in the cylinder; and a second pin connecting said lever and said slider;

a third pin is secured to the top surface of the sealing element; and a slot provided at the first end of the lever fits the third pin.

2. The sealing element of claim 1, further comprising a contact element provided on the tip end of the rod which allows the position of the contact element to be freely adjusted;

the contact element having a first end adapted to protrude from the side edge of the door and a second end; and a second spring exerting force on the second end of the contact element so as to come the first end to protrude from the side edge of the door when the door is opened, wherein when the door is closed, the contact element collides with a door frame and the contact element withdraws into the door in opposition to the second spring.

3. The sealing device of claim 1, wherein a stabilizer having walls facing each other and protruding upward is secured to the top surface of the sealing element;

said third pin is connected to the lever provided between the stabilizer walls;

protruding partitions are provided perpendicular and integral with inner walls of the channel member to divide the channel member into upper and lower chambers, said partitions having free ends that are spaced from one another to provide a clearance therebetween; and the stabilizer is inserted and connected in the clearance provided by the protruding partitions.

* * * * *